US008287200B2

(12) United States Patent
Chevalier et al.

(10) Patent No.: US 8,287,200 B2
(45) Date of Patent: Oct. 16, 2012

(54) RECEPTACLE COMPRISING A CONTAINER FOR LIQUID PRODUCT, DEVICE COMPRISING SUCH A RECEPTACLE AND USE OF SUCH A DEVICE FOR APPLYING THE PRODUCT CONTAINED IN THE RECEPTACLE TO A SURFACE

(75) Inventors: Marc Chevalier, Franconville (FR); Jean-Francois Tranchant, Marigny-les-Usages (FR); Myriam Chevalier, Bolgny-sur-Blonne (FR)

(73) Assignee: L V M H Recherche, Saint Jean de Braye (FR)

( * ) Notice: Subject to any disclaimer, the term of this patent is extended or adjusted under 35 U.S.C. 154(b) by 260 days.

(21) Appl. No.: 12/856,331

(22) Filed: Aug. 13, 2010

(65) Prior Publication Data

US 2011/0052304 A1 Mar. 3, 2011

(51) Int. Cl.
*A46B 17/08* (2006.01)

(52) U.S. Cl. ..... 401/122

(58) Field of Classification Search ..... 401/118, 401/121, 122

See application file for complete search history.

(56) References Cited

U.S. PATENT DOCUMENTS

| | | | | |
|---|---|---|---|---|
| 2,815,146 | A | 12/1957 | Silver | |
| 4,470,425 | A * | 9/1984 | Gueret | 132/218 |
| 5,873,669 | A | 2/1999 | Poore et al. | |
| 7,186,044 | B2 * | 3/2007 | Bailly | 401/122 |
| 7,278,798 | B1 * | 10/2007 | Kearney | 401/129 |
| 2005/0220528 | A1 | 10/2005 | Petit | |

FOREIGN PATENT DOCUMENTS

| | | |
|---|---|---|
| DE | 484 518 | 10/1929 |
| EP | 0 490 449 | 6/1992 |
| EP | 1 714 578 | 10/2006 |

* cited by examiner

*Primary Examiner* — Huyen Le
(74) *Attorney, Agent, or Firm* — Miller, Matthias & Hull LLP

(57) ABSTRACT

Receptacle comprising a neck provided with an opening intended for the passage of an applicator head, and a container for liquid product, and a wiping member. The wiping member includes an annular sleeve fitted into the neck and a wiping lip connected to the annular sleeve and capable of allowing the wiping of the applicator head. The wiping lip is fixed immovably to the annular sleeve while being arranged inside the annular sleeve close to the opening and is radially separated from the annular sleeve by an annular space provided with slots opening axially towards the inside of the sleeve and the container.

20 Claims, 2 Drawing Sheets

RECEPTACLE COMPRISING A CONTAINER FOR LIQUID PRODUCT, DEVICE COMPRISING SUCH A RECEPTACLE AND USE OF SUCH A DEVICE FOR APPLYING THE PRODUCT CONTAINED IN THE RECEPTACLE TO A SURFACE

CROSS-REFERENCE TO RELATED APPLICATION

This application claims priority under the Paris Convention and 35 USC §119 to French Application No. 09 55872, filed on Aug. 28, 2009.

FIELD OF THE DISCLOSURE

The present invention relates to receptacles comprising a container for holding a liquid product, devices comprising such receptacles and an applicator formed from a handle connected to an applicator head, as well as to the use of such devices for applying a more or less viscous liquid product held in the container of the receptacle to a surface.

More precisely, the liquid product receptacle comprises:

- a neck extending along a central axis up to a free end provided with an opening intended for the passage of an applicator head,
- a container for holding the liquid product, comprising a base, an opening communicating with the neck, and a side wall extending between the base and the abovementioned opening, and
- a wiping member including:
  - an annular sleeve fitted into the neck, and
  - a wiping lip connected to the annular sleeve and capable of allowing the wiping of the applicator head.

BACKGROUND OF THE DISCLOSURE

The ink container described in document U.S. Pat. No. 582,127 is provided with a collar forming a wiping member fitted into the neck and provided with a lip intended for wiping a pen.

However, the drawback of said type of collar is that the ink collected on said lip dries forming a wad; it follows that wiping becomes less and less effective over time.

The container described in document U.S. Pat. No. 2,815,146 is provided with a ring forming a wiping member crimped into the neck and forming a lip intended for wiping. Said ring is mobile and pre-stressed so that when the container is opened, the ring kept compressed under the cap extends out of the neck as soon as the container is opened.

Thus, on closing the container, the ring is again kept compressed under the cap and therefore, the product wiped against the ring will, while drying, stick the latter against the cap. When next opened, the cap can be withdrawn, but the ring will be coated with dried product and risks remaining at least partly stuck during the removal of the cap.

SUMMARY OF THE DISCLOSURE

A purpose of the present invention is in particular to improve the wiping of the applicator head and to remedy these drawbacks.

To this end, according to the invention, the wiping lip is fixed immovably to the annular sleeve while being arranged inside said annular sleeve in proximity to the opening of the neck of the receptacle, said wiping lip being radially separated from the annular sleeve by an annular space provided with at least one slot opening axially towards the inside of said annular sleeve and container.

These arrangements facilitate the wiping of the applicator head, and the excess product wiped against the wiping lip and recovered in the annular space can flow easily towards the base of the container through the slot. Thus, the accumulation of product having dried on the applicator head is very significantly reduced.

Furthermore, through these arrangements, the movements of the operator are unchanged, as access to the wiping lip is gained conventionally as for accessing the content of the container.

In various embodiments of the invention, it is moreover possible optionally to resort to one and/or the other of the following arrangements:

- the slot occupies between 10% and 30% of the circumference of the annular space;
- the inside diameter of the wiping lip is substantially equal to the inside diameter of the annular sleeve;
- the wiping member also comprises a squeezing member capable of squeezing a rod fixed to the applicator head and arranged in the annular sleeve of the wiping member, towards the inside of the container with respect to the wiping lip;
- the side wall of the container extends over a height between the base and the opening of the container, and the annular sleeve of the wiping member extends towards the base of the container so that the distance between the lower end of the annular sleeve and the base of the container is at most half, and preferably at most one-third, of the height of the side wall of the container.

Moreover, a subject of the invention is also a device comprising such a receptacle and an applicator formed from a handle connected to an applicator head, the handle forming a closure for said receptacle. Said device can optionally also comprise one and/or the other of the following characteristics: the applicator head is a brush;

- the handle makes it possible to close the receptacle being arranged so that the bristles of the brush are placed at least partly in the annular sleeve when said handle closes the container;
- the handle is connected to the applicator head via a rod, said rod having a diameter greater than or equal to the diameter of the applicator head.

Moreover, a subject of the invention is also the use of such a device for applying a more or less viscous liquid product held in the container to a surface.

The liquid product held in the container can have a viscosity at 25° C. comprised between 5 mPa·s and 5,000 mPa·s, preferably between 20 and 4,000 mPa·s, and the surface can be an area of the human body, in particular for applying a liquid cosmetic product, for example a nail varnish.

BRIEF DESCRIPTION OF THE DRAWINGS

The invention will be better understood and its advantages will become more clearly apparent from the following detailed description of an embodiment of the invention given by way of a non-limitative example.

The description refers to the attached drawings in which.

DETAILED DESCRIPTION OF THE DRAWINGS

Figure 1:
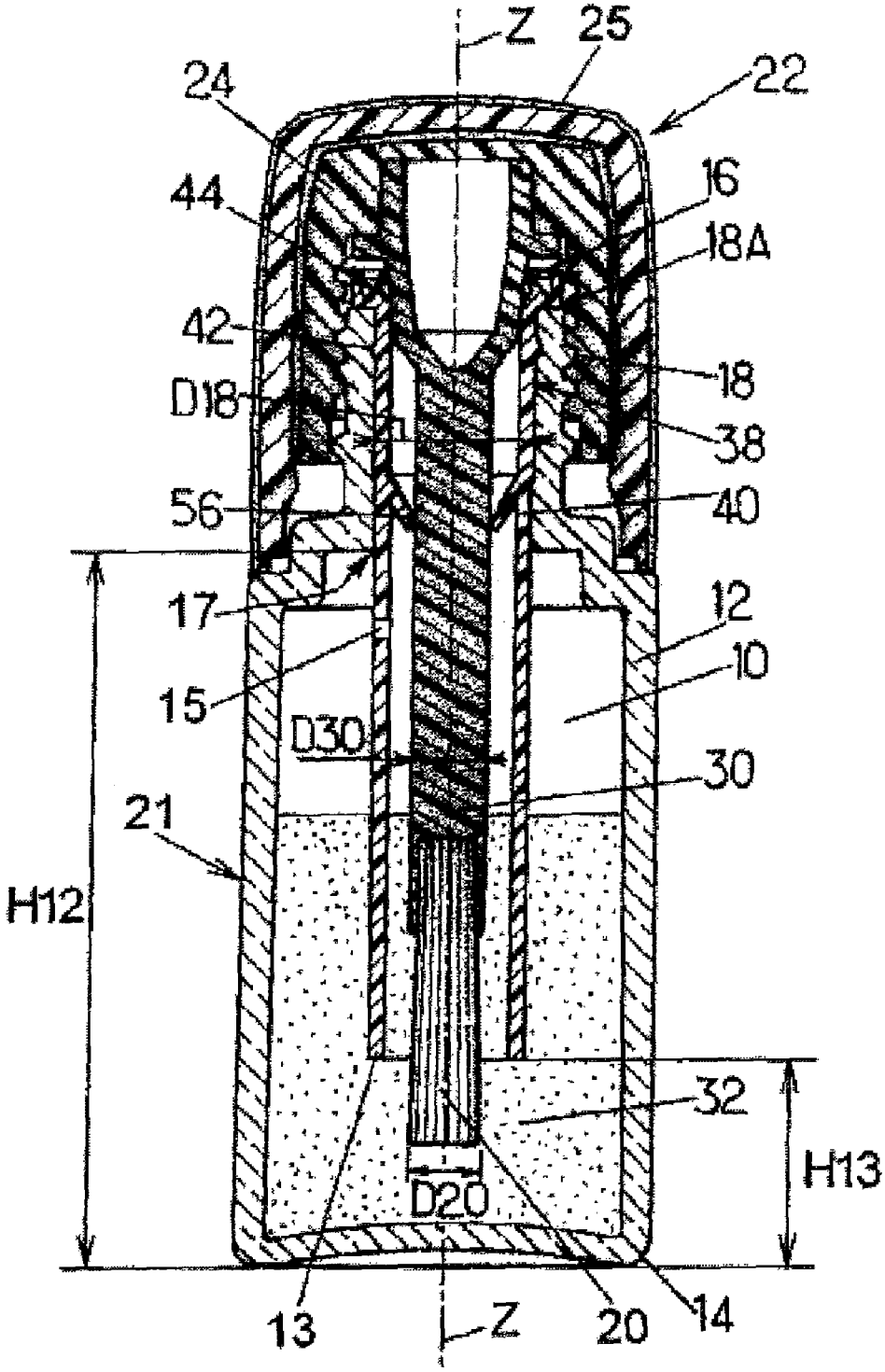
FIG. 1 shows a cross-section of the device according to an embodiment of the invention, along a plane passing through its central axis of symmetry (Z)

The device 22 illustrated in FIG. 1 comprises a receptacle 21 and an applicator formed from a handle 24 connected to an applicator head 20, the handle 24 forming a closure for the receptacle 21. For aesthetic reasons, the handle 24 forming a closure can be surmounted by a detachable cap 25 covering all or part thereof. It is also possible to provide for the handle 24 and the cap 25 to form a single piece.

The receptacle 21 comprises:

a neck 18 extending along a central axis Z up to a free end 18A provided with an opening 16 intended for the passage of the applicator head 20, and a container 10 comprising a side wall 12 extending along the central axis Z between a base 14 and an opening 17 communicating with the neck 18.

In the case in point, the neck 18 is provided, in a known manner, with a male thread 26 and the handle 24 is provided with a female thread 28 so that the handle 24 can be fixed to the container 10 when closing said container.

The applicator head 20 is advantageously fixed to the handle 24 via a rod 30 extending preferably along the central axis Z.

The container 10 can be produced from a polyamide material, such as for example the polyamides marketed by EMS under the name Grivory®, in particular Grivory® G21.

Figure 2:
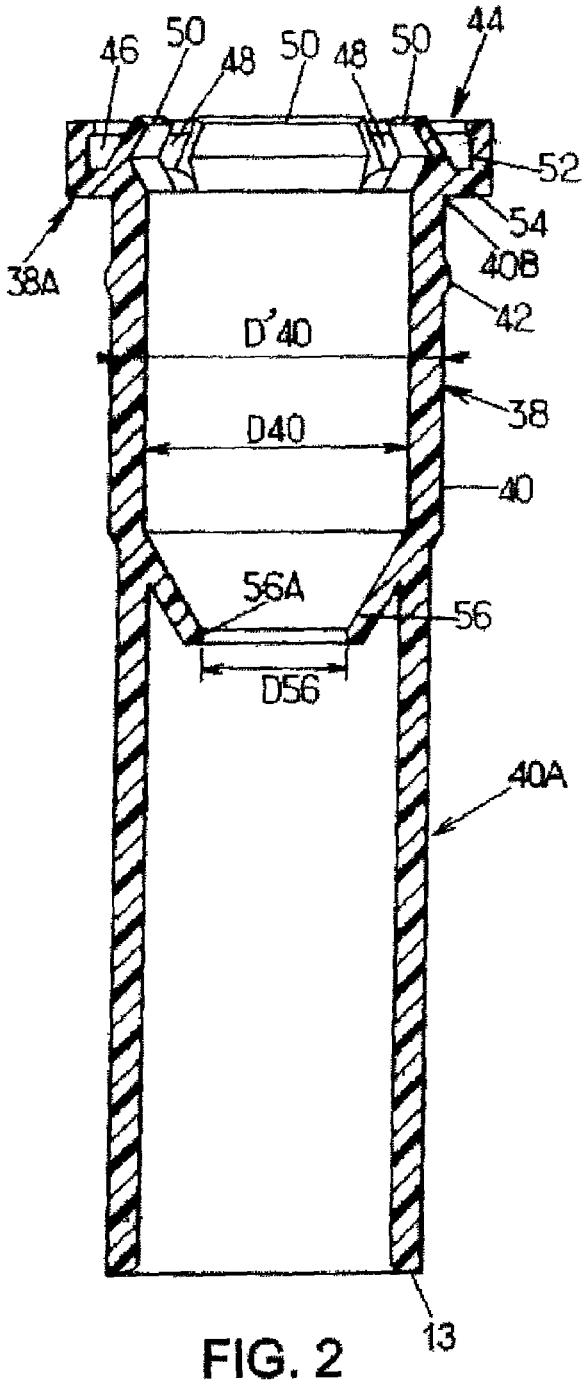
FIG. 2 shows a longitudinal cross-section of the wiping member of the device in FIG. 1.
Figure 4:
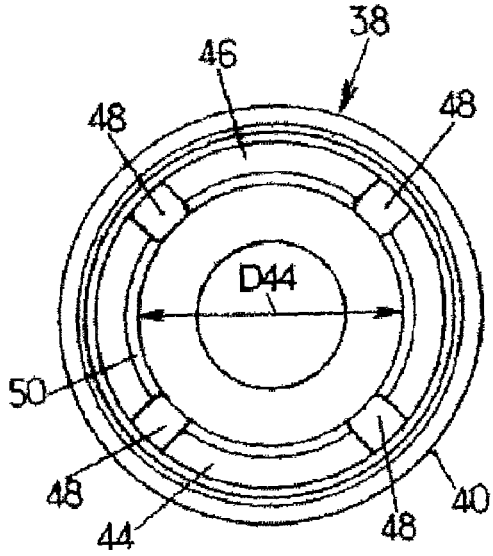
FIG. 4 shows a top view of the wiping member in FIG. 2.
Figure 3:
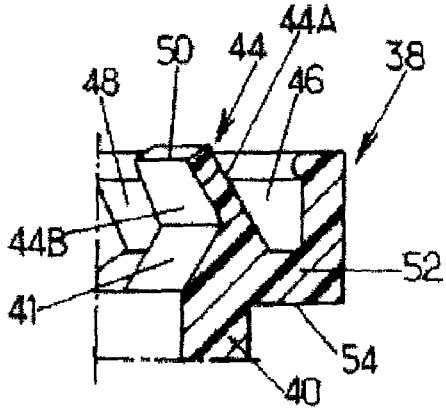
FIG. 3 shows a detailed cross-section of the lip of the wiping member in FIG. 2.

Moreover, the container 10 is provided with a wiping member 38 as shown in detail in FIGS. 2 to 4. Said wiping member 38 includes an annular sleeve 40 fitted, preferably force-fitted, in the neck 18. To this end the annular sleeve 40 has an outside diameter D'40 substantially equal to the inside diameter D18 of the neck 18 over at least the majority of the surface of the annular sleeve 40 in contact against the neck 18. On the other hand, in order to facilitate placing the wiping member 38 in the container 10, the annular sleeve 40 can have an outside diameter D'40 that is smaller in the lower portion 40A, the part inserted the furthest into the container 10, than in the upper portion 40B, the part fitted into the neck 18 of the receptacle 21. The insertion of the annular sleeve 40 is facilitated thereby, since over the majority of its height (of the order of at least half of its height H40), its outside diameter is substantially smaller than the inside diameter D18 of the neck 18.

In order to ensure that said wiping member 38 is held in place in the receptacle 21, a preferably annular bead 42 is provided on an area of the outer wall of the upper portion 40B of the annular sleeve 40, ensuring that the wiping member 38 is held in the neck 18 of the receptacle 21.

As better illustrated in FIG. 2 and shown in detail in FIG. 3, the wiping member 38 includes moreover a wiping lip 44 connected to the annular sleeve 40 of the wiping member 38 in order to allow for the applicator head 20 to be wiped.

In order to allow for the excess product 32 on the applicator head 20 to be recovered and returned to the container 10, the wiping lip 44 is radially separated from the annular sleeve 40 of the wiping member 38 by an annular space 46 provided with at least one slot 48 opening axially towards the inside of the container 10.

In order to ensure that the maximum of wiped product flows towards the base of the container 10 without drying on the wiping lip 44, the slot 48 preferably occupies between 10% and 30% of the circumference of the annular space 46. In the case in point, as shown in FIG. 4, the annular space 46 is provided with four slots 48 preferably distributed evenly over the circumference of the annular space 46.

The annular space 46 forms a kind of catcher of excess product that when wiped off on the wiping lips 44 will be able to collect in the base of the container 10 via these slots 48.

In order to facilitate the wiping of the applicator head 20 using the wiping lip 44, and in particular using its free upper inside edge 50, the wiping lip 44 is fixed immovably to the annular sleeve 40 of the wiping member 38 and is sufficiently rigid to withstand any possible deformation that could take place over time.

The inside diameter D44 of the wiping lip 44, measured at the level of the upper inside edge 50 of said lip, is preferably substantially equal to the inside diameter D40 of the annular sleeve 40. To this end, the wiping member 38 has, at the free end 38A of the element 38 situated close to the opening 16 of the neck 18, an outer skirt 52 allowing the wiping lip 44 and the annular space 46 to be offset radially outwards, outside the container 10.

With reference to FIG. 4, the lip 44 extends upwards from the base of the annular space 46 of the wiping member 38 (opposite the base 14 of the container 10) up to its free end forming the upper edge 50. The lip 44 thus extends on the side of the annular space 46, forming a downwardly-diverging substantially tapered upper surface 44A. Towards the inside of the wiping member 38, the lip 44 also extends forming a downwardly-diverging substantially tapered lower surface 44B, substantially parallel to the wall 44A. Said lower surface 44A is connected to the annular sleeve 40 by another surface 41, also preferably substantially tapered but downwardly converging to the inner surface of the sleeve 40.

Moreover, a shoulder 54, formed between the skirt 52 and the annular sleeve 40, forms a bearing and stop surface for the wiping member 38 when the annular sleeve 40 is inserted into the neck 18 of the receptacle 21.

In order to prevent the loss by evaporation of the product 32 held in the container 10 as soon as the latter is opened, in particular when the product contains volatile substances (such as solvent for example), the annular sleeve 40 can extend downwards towards the base 14 of the container 10, so that the distance H13 between the lower end 13 of the annular sleeve 40 and the base 14 of the container 10 is at most equal to one half, and preferably at most equal to one third, of the height H12 of the side wall 12 of the container 10, measured between the base 14 and the free end 18A of the neck 18, according to the composition of product held in the container 10. It can be advantageous moreover to produce an aperture 15 in the wall of the annular sleeve 40 situated inside the container 10 close to its opening 17, said aperture forming a vent in order to equalize the air pressure between the space situated above the free surface of the liquid product in the container and the space inside said sleeve.

In order to recover any product that has accumulated on the rod 30 of the applicator head 20, the wiping member 38 can moreover comprise a squeezing member 56 capable of squeezing the rod 30. The squeezing member 56 is fixed and concentrically arranged inside the annular sleeve 40, and it advantageously has a tapered shape converging towards the base of the container 10.

In order to provide the squeezing of the rod 30, the internal diameter D56 of the squeezing member 56, measured at its free end 56A, is substantially equal to the diameter D30 of the rod 30. Moreover, the diameter D30 of the rod 30 is preferably greater than or equal to the diameter D20 of the applicator head 20, such that the squeezing member 56 can squeeze the rod 30 without thereby involving a risk of deterioration of the applicator head 20.

According to the nature of the product 32 held in the container 10, the applicator head 20 can be a brush or any other type of applicator, with rigid or flexible bristles or without bristles, etc.

In order to prevent as far as possible the evaporation of the product 32 held in the container 10, the applicator head 20, and in particular the bristles forming the applicator head 20 in the case of a brush, are placed at least partly in the annular sleeve 40 when the handle 24 closes the container 10.

The container 10 of the device 22 according to the invention is particularly intended to contain a more or less viscous liquid product 32, intended to be applied to a surface. The use of such a device according to the invention is particularly advantageous when the container 10 contains a product chosen from coating products (mainly intended for DIY) of the paint, lacquer or varnish type or for use on the body; the product 32 can be a pharmaceutical product or a cosmetic product of the nail varnish, mascara, lipstick, foundation or lip gloss type, etc.

The use of the device according to the invention is particularly advantageous for a liquid product having a viscosity at 25° C. comprised between 5 mPa·s and 5,000 mPa·s, preferably between 20 and 4,000 mPa·s.

According to the nature of the product 32 held in the container 2, the use of the device according to the invention will be directed towards a physical surface to be coated or towards an area of the human body.

It will be noted that the receptacle 21 can optionally be sold alone without the applicator, as a refill. In this case, the receptacle 21 can be closed by a simple closure (not shown) without the applicator head 20 or the rod 30, the simple closure being replaced at the start of use by an assembly 24, 20, 30 as described above, from a previously used complete device.

The invention claimed is:

1. A receptacle for liquid product comprising:

a neck extending along a central axis up to a free end provided with an opening intended for the passage of an applicator head, a container for containing the liquid product, comprising a base, an opening communicating with the neck, and a side wall extending between the base and the abovementioned opening, and a wiping member comprising:

an annular sleeve fitted into the neck, and a wiping lip connected to the annular sleeve and capable of allowing the wiping of the applicator head, wherein the wiping lip is immovably fixed to the annular sleeve while being arranged inside the annular sleeve close to the opening, said wiping lip being radially separated from the annular sleeve by an annular space provided with at least one slot opening axially towards the inside of the annular sleeve and the container, and in that the inside diameter of the wiping lip is substantially equal to the inside diameter of the annular sleeve.

2. The receptacle according to claim 1, in which the total width of the slot, or the slots, occupies between 10% and 30% of the circumference of the annular space.

3. The receptacle according to claim 2, in which the wiping member also comprises a squeezing member capable of squeezing a rod fixed to the applicator head and arranged in the annular sleeve of the wiping member, towards the inside of the container with respect to the wiping lip.

4. The receptacle according to claim 2, in which the side wall of the container extends over a certain height between the base and the opening of the container, and in which the annular sleeve of the wiping member extends towards the base of the container so that the distance between the lower end of the annular sleeve and the base of the container is at most one half, and preferably at most one third, of the height of the side wall of the container.

5. The device comprising a receptacle according to claim 2, and an applicator formed from a handle connected to an applicator head, the handle forming a closure for the receptacle.

6. Use of a device according to claim 5, for applying a more or less viscous liquid product held in the container to a surface.

7. Use according to the claim 6, for which the liquid product has a viscosity at 25° C. comprised between 5 mPa·s and 5,000 mPa·s, preferably between 20 and 4,000 mPa·s.

8. The receptacle according to claim 1, in which the wiping member also comprises a squeezing member capable of squeezing a rod fixed to the applicator head and arranged in the annular sleeve of the wiping member, towards the inside of the container with respect to the wiping lip.

9. The receptacle according to claim 8, in which the side wall of the container extends over a certain height between the base and the opening of the container, and in which the annular sleeve of the wiping member extends towards the base of the container so that the distance between the lower end of the annular sleeve and the base of the container is at most one half, and preferably at most one third, of the height of the side wall of the container.

10. The device comprising a receptacle according to claim 8, and an applicator formed from a handle connected to an applicator head, the handle forming a closure for the receptacle.

11. The receptacle according to claim 1, in which the side wall of the container extends over a certain height between the base and the opening of the container, and in which the annular sleeve of the wiping member extends towards the base of the container so that the distance between the lower end of the annular sleeve and the base of the container is at most one half, and preferably at most one third, of the height of the side wall of the container.

12. The device comprising a receptacle according to claim 11, and an applicator formed from a handle connected to an applicator head, the handle forming a closure for the receptacle.

13. The device according to the claim 12, in which the applicator head is a brush and the handle makes it possible to close the receptacle while being arranged so that the bristles of the brush are placed at least partly in the annular sleeve when said handle closes the container.

14. The device according to claim 12, in which the handle is connected to the applicator head via a rod, said rod having a diameter greater than or equal to the diameter of applicator head.

15. The device comprising a receptacle according to claim 1 and an applicator formed from a handle connected to an applicator head, the handle forming a closure for the receptacle.

16. The device according to the claim 15, in which the applicator head is a brush.

17. The device according to claim 16, in which the handle makes it possible to close the receptacle while being arranged so that the bristles of the brush are placed at least partly in the annular sleeve when said handle closes the container.

18. The device according to claim 15, in which the handle is connected to the applicator head via a rod, said rod having a diameter greater than or equal to the diameter of applicator head.

19. Use of a device according to claim 15, for applying a more or less viscous liquid product held in the container to a surface.

20. Use according to claim 19, for which the liquid product has a viscosity at 25° C. comprised between 5 mPa·s and 5,000 mPa·s, preferably between 20 and 4,000 mPa·s.

* * * * *